US005116653A

United States Patent [19]

Frandina

[11] Patent Number: 5,116,653

[45] Date of Patent: May 26, 1992

[54] EXPANSION JOINT

[76] Inventor: Antonio Frandina, 259-60 Craft Ave., Rosedale, N.Y. 11422

[21] Appl. No.: 660,144

[22] Filed: Feb. 22, 1991

[51] Int. Cl.[5] ..... B32B 3/00; B32B 13/00

[52] U.S. Cl. ..... 428/58; 404/56; 404/58; 404/67; 428/67; 428/703

[58] Field of Search ..... 404/56, 57, 58, 66, 404/67; 428/56, 57, 58, 67, 703

[56] References Cited

U.S. PATENT DOCUMENTS 2,536,611 1/1951 Miller ..... 428/58

3,406,087 10/1968 Potter ..... 428/57

OTHER PUBLICATIONS

Dodge-Regupol Specification Sheet for Indoor/Outdoor Athletic Surfacing (no date).

Dodge-Regupol Specification Sheet for Multipurpose Gymnasium Flooring (no date).

*Primary Examiner*—William J. Van Balen

*Attorney, Agent, or Firm*—Collard & Roe

[57] ABSTRACT

An improved expansion joint material for placement between adjoining slabs of concrete. The material is a non-porous water impermeable, polymerically bound reclaimed rubber and/or foam particles. The material is treated so as to be resistant to microbes, oil and fungi.

4 Claims, 1 Drawing Sheet

EXPANSION JOINT

BACKGROUND OF THE INVENTION

The invention relates to a compact, water impermeable rubber material for use as expansion joints in roadways, sidewalks and similar structures. More particularly, it relates to a novel combination of concrete members and impermeable rubber material, which provides for an improved expansion joint compared with felt joint fillers, which are currently used.

In the construction of roads and sidewalks expansion joints are placed at regular intervals to compensate for the contraction and expansion of the material used as the pavement. In this manner discrete sections of roadway or sidewalk can expand and contract independently of each other without causing undue stress or cracks in the surface.

Typically, a felt strip is laid vertically at regular intervals between adjoining slabs to provide an expansion joint. However, there are many drawbacks to using a felt-like material. It should be pointed out that expansion joints generally create a problem in that they interrupt what would otherwise be a continuous top surface. These gaps can allow water to get beneath the surface which creates problems upon freezing due to expansion. Felt is a material comprised of wool, fur or hair, for example, which is compressed and heated to form a solid material. As can be appreciated, felt is not particularly weather resistant or water impermeable. As a result water can seep through a felt expansion joint and accumulate underneath the paving surface. This is particularly a problem during colder weather when sections of roadway or sidewalk would be most contracted resulting in larger gaps, in the area of the expansion joints, than would be present in warmer months. In addition, water, which permeates the expansion joint filler is likely to freeze during colder months.

In order to overcome some of these deficiencies, part of the felt expansion joint, which is visible between two slabs is removed. For example, the exposed felt is milled out approximately one half inch down. This creates a gap between slabs, which is then filled with a sealer, e.g. tar. This is an expensive and time-consuming process.

Various attempts have been made to provide an expansion joint material which overcomes these deficiencies. U.S. Pat. No. 1,280,572 issued to Spiegel on Oct. 1, 1918 describes an expansion joint for roads which comprises a resilient material having surface layers of non-resilient material adhesively fixed to it. Spiegel suggests the following as materials which can be used for his expansion joint. The resilient portion of the joint is a compound which consists of asphalt, sawdust, spent tan bark or like ingredients. Surrounding this core are two felt strips saturated with asphalt. An additional layer of asphalt with a high melting point is then applied. Finally, crushed stone is applied to the outer surface. The roughened outer surface is intended to readily adhere to the face of the adjacent road bed. in this manner it is hoped that gaps will not form between the expansion joint material and the roadway.

The Spiegel expansion joint has several drawbacks. First, it is not made of uniform material. The embodiment in FIG. 2 shows nine (9) layers of material. This has obvious disadvantages with regard to cost and complexity of manufacture. In addition, compound 1 includes organic materials which are not water impermeable. Felt strips 2, although including asphalt, are not totally waterproof.

U.S. Pat. No. 1,248,909 issued to Pullar on Dec. 4, 1917 discloses a bitumen product which can be used as an expansion joint. The material is made by incorporating a layer of woven or mesh fabric to the surfaces of a pure asphalt or bituminous compound. Pullar suggests using a fabric woven or formed with a mesh within the range of about 10 to about 200 openings per square inch. The mesh is applied to the bituminous material by mechanical pressing and then subjecting the surface to a heating process. The result is that the bituminous material flows through the openings of the fabric and forms an integrally connected thin bonding film on the outer surface of the fabric. Again, Pullar has the disadvantage that it is not of uniform composition.

Gage, U.S. Pat. No. 1,637,480 describes a device to prevent cracks from forming in the surface of a pavement where cracks reside in the underlying foundation. In Gage, strips of bituminous impregnated felts or fabrics can be laid across the existing openings to prevent surface paving material from working its way into the openings. This method allows movement of the underlying foundation in the vicinity of the crack without translation through movement in the paved surface. Although Gage solves the problem of movement in the underlying foundation, he does not provide for expansion in the top surface. Also, the method does not require these strips to be exposed. As a result, Gage offers a material which is water permeable and therefore not suitable for an exposed expansion joint.

SUMMARY OF THE INVENTION

It is therefore an object of the present invention to eliminate the aforementioned drawbacks of the prior art and to provide an expansion joint, which is impermeable to water.

It is the further object of the present invention to provide such a joint, which is of uniform composition, and easily manufactured.

It is yet a further object of the invention to provide an expansion joint which can be manufactured to match the color of the paved surface.

These and other related objects are attained according to the invention by a novel combination including concrete members and an expansion joint. The expansion joint consists of a resilient, compact, water-impermeable rubber material. It is created by fusing together shredded rubber. The relative size of the shreds and the degree of fusion can be adjusted depending on the desired density of the finished product. Other material characteristics can also be adjusted in this way and by other similar methods.

Other objects and features of the present invention will become apparent from the following details description considered in connection with the accompanying drawing. It is to be understood, however, that the drawing is designed as an illustration only, and not as a definition of the limits of the invention.

BRIEF DESCRIPTION OF THE DRAWINGS

In the drawing, wherein similar numbers represent similar figures on different drawings, the object of the invention is shown only schematically, with the Figures showing the following.

DETAILED DESCRIPTION OF THE PREFERRED EMBODIMENT

Figure 1:
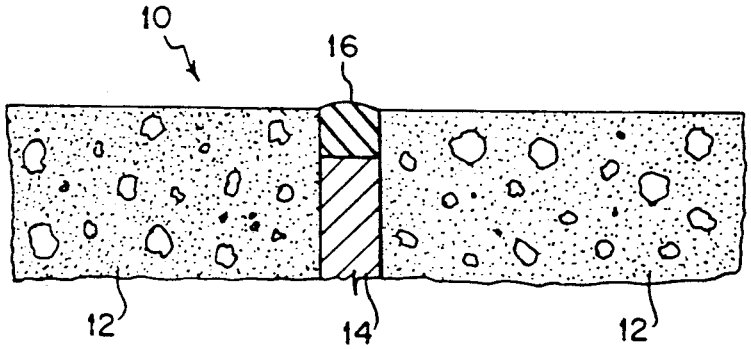
FIG. 1 (Prior Art)
FIG. 1 is a cross-sectional view of an expansion joint of the prior art.

Referring now in detail to the drawing and, in particular FIG. 1, there is illustrated an expansion joint 10 according to the prior art. Two concrete slabs 12 are shown with an expansion joint provided therebetween. Typically, a roadway or sidewalk is formed of a series of concrete slabs 12. Ideally, the top surface would form a continuous water impermeable layer. However, due to the expansion and contraction brought about by changes in temperature, concrete slabs 12 must be formed into isolated sections. The size of an individual section is such that expansion and contraction will not effect its integrity.

Advantageously, these discrete concrete slabs 12 will each maintain their integrity, due to their size and thus the roadway as a whole will require less maintenance. However, the expansion joint provides a gap where water can enter and damage the adjoining concrete slabs 12. The expansion joint is provided with a felt strip 14 which is partially milled out. Above felt strip 14 is a bead of tar 16 which seals out water. However, it is an extremely time consuming process to mill out the felt strips, especially when extended lengths of roadway are being paved. Even with this method, sometimes in extremely cold temperatures, concrete slabs 12 can contract so significantly that a gap is created between concrete slab 12 and combined felt strip 14 and tar bead 16 This provides an opportunity for water to enter through the joint and freeze up, thereby forming a greater gap within the joint, or causing the concrete slab 12 to rise up from its sub-base.

Figure 2:
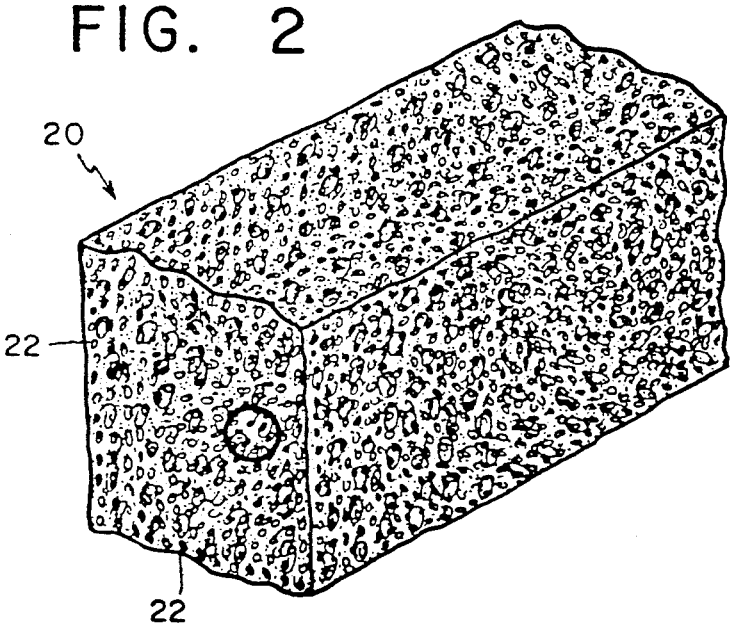
FIG. 2 is a perspective view of the material embodying the present invention.
Figure 4:
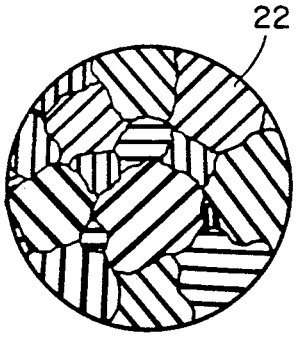
FIG. 4 is an enlarged view of the material from FIG. 2.

FIG. 2 shows a close-up view of the expansion joint material embodying the present invention. As can be seen, expansion joint 20 is made of shredded rubber 22. These pieces of shredded rubber 22 can be shredded to a variety of sizes. This would effect the material characteristics of the joint filler 20 as smaller shreds would generally form smaller air spaces within the material. These shreds are then fused together to form a strip. FIG. 4 shows shredded rubber 22 fused together. The degree of fusion can further alter the material characteristics. For example, the density can vary from 28 lbs. per cubic foot to 60 lbs. per cubic foot.

The shreds are made of polymerically bound reclaimed rubber and/or foam particles treated to resist most types of microbes, oils, and fungi. In other words, the material will not support biological growth, thus preventing weeds from growing between cracks in the sidewalk. The material ideally possesses the following material characteristics:

TABLE 1

| CHARACTERISTIC | STANDARD* | RATING |
|---|---|---|
| Elongation at break | ASTM D-412 | 90% |
| Resilience | ASTM D-2632 | 32% |
| Tensile Strength | ASTM D-412 | 174 p.s.i. |
| Hardness | ASTM Shore A D-2440 | 42–44 |
| Compression set | ASTM D-395 | 26.8% |
| Compression Properties | ASTM D-575/ 10% | 58 p.s.i. |
| Compression Properties | ASTM D-575/ 50% | 871 p.s.i. |
| Abrasion Resistance | ASTM D-1044 | .425 g |
| Coefficient or Friction | ASTM D-1894/ wet | .725 |
| Coefficient or Friction | ASTM D-1894/ dry | .696 |
| Compression Set | 50% compression at 22° C. | 97–99% recovery after 72 hours |
| Compression Properties | 10 modules | 10 p.s.i. |
| Compression Properties | 50 modules | 710 p.s.i. |
| Abrasion Resistance of wear coat | DIN 18032 | RV = 32 |
| Energy Recovery | | 80% |

*ASTM - American Society of Testing Materials

Figure 3:
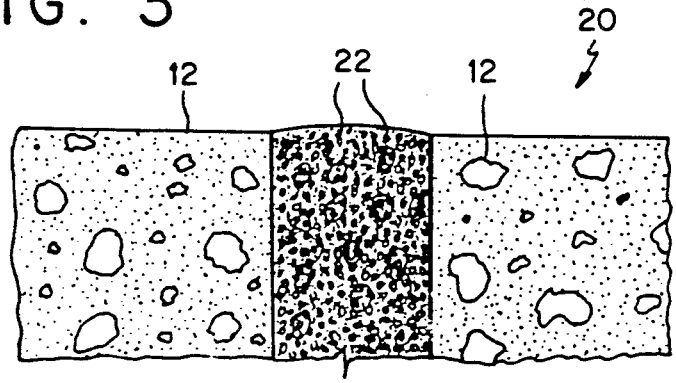
FIG. 3 is a cross-sectional view of an expansion joint according to the invention.

The material can be manufactured in a wide range of colors. This is especially important since expansion joint material 20 will be exposed between concrete slabs 12, as shown in FIG. 3. The color can be matched to the adjacent slabs. The material may also be ozone resistant. The material is capable of greater compression at pouring than felt, thus insuring a tighter seal.

Thus, while only a single embodiment of the present invention has been shown and described, it is obvious that many changes and modifications may be made thereunto, without departing from the spirit and scope of the invention.

What is claimed is:

1. In combination, a concrete member, and a joint filler of non-porous, water impermeable material made from polymerically bound rubber particles treated so as to be resistant to microbes, oils and fungi, said material being formed in an elongated strip for insertion between the slab ends.

2. The combination as recited in claim 1, wherein said material has an elongation at brake of 90% according to ASTM D-412, and a resilience of 32% according to ASTM D-2632, and a tensile strength of 174 p.s.i. according to ASTM D-412, and a hardness in the range of 42–44 according to ASTM Shore A D-2440, and a compression set of 26.8% according to ASTM D-395, and compression properties of 58 p.s.i. at 10% according to ASTM D-575, and 871 p.s.i. at 50% according to ASTM D-575, and abrasion resistance of 0.425 g according to ASTM D-1044, and a coefficient of friction wet of 0.725 according to ASTM D-1894, and a coefficient of friction dry of 0.696 according to ASTM D-1894.

3. In combination, a concrete member and a joint filler of non-porous, water impermeable material made from polymerically bound foam particles, treated so as to be resistant to microbes, oils and fungi, said material being formed in an elongated strip for insertion between the slab ends.

4. A joint filler of non-porous, water impermeable material selected from the group consisting of polymerically bound reclaimed rubber, polymerically bound foam particles, or polymerically bound reclaimed rubber and polymerically bound foam particles treated so as to be resistant to microbes, oils and fungi, said material being formed in an elongated strip for insertion between the slab ends having a compression set in the range of 97–99% recovery after 72 hours from 50% compression at 22° C., and compression properties of 100 p.s.i. at 10% modules and 710 p.s.i. at 50% modules, and abrasion resistance of wear coat of RV=32 according to DIN 18032 and energy recovery of 80%.

* * * * *